US006378165B1

(12) United States Patent
Holsten et al.

(10) Patent No.: US 6,378,165 B1
(45) Date of Patent: Apr. 30, 2002

(54) PULL HANDLE WITH INTERLOCKING MOUNTING MECHANISM FOR WET/DRY VACUUM APPLIANCE

(75) Inventors: Stuart V. Holsten, O'Fallon; David E. Beth, St. Charles, both of MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/506,118

(22) Filed: Feb. 17, 2000

(51) Int. Cl.[7] ..... A47L 9/32
(52) U.S. Cl. ..... 15/410; 15/327.2; 16/110 R
(58) Field of Search ..... 15/327.2, 410; 16/110 R

(56) References Cited

U.S. PATENT DOCUMENTS 2,867,834 A * 1/1959 Kelly ..... 15/410 X
3,170,184 A * 2/1965 Jepson et al. ..... 15/327.1 X
3,766,594 A * 10/1973 Westergren et al. ..... 15/410 X
3,858,272 A * 1/1975 Bard et al. ..... 15/410 X
4,670,937 A * 6/1987 Sumerau et al. ..... 15/410 X
5,301,386 A * 4/1994 Thomas et al. ..... 15/410 X
5,406,673 A * 4/1995 Bradd et al. ..... 15/410 X
6,154,921 A * 12/2000 Green et al. ..... 15/327.2 X

* cited by examiner

*Primary Examiner*—Chris K. Moore
(74) *Attorney, Agent, or Firm*—Howrey Simon Arnold & White, LLP

(57) ABSTRACT

The present invention is a handle used for pulling a wet/dry vacuum appliance and a mechanism for securely mounting such a handle to the lid of the vacuum. The mounting mechanism is designed for ease of assembly and reduced fastener cost. The handle is attached at two of its four attachment points by inserting journals molded into the sides of the handle into open bearing pockets molded in handle receiving recesses on the lid of the vacuum. The handle is then rotated into place and secured at the remaining two attachment points with suitable fasteners, such as screws. In certain embodiments of this invention, when the handle is rotated into position for attachment a locking slot in the bottom surface of the handle engages a rib provided in the handle receiving recess of the lid. This rib guides the handle as it rotates, prevents the journals from sliding back out of the bearing pockets, and locks the handle into the proper position for insertion of the fasteners.

10 Claims, 10 Drawing Sheets

PULL HANDLE WITH INTERLOCKING MOUNTING MECHANISM FOR WET/DRY VACUUM APPLIANCE

BACKGROUND OF THE INVENTION

1. Field of the Invention

This invention relates generally to wet/dry vacuum cleaning appliances, and more particularly, to a novel pull handle for such appliances.

2. Background Art

Wet/dry vacuum cleaners known in the art are generally provided with a wheeled base so that the unit may be moved as necessary. Such bases may be formed as an integral part of the vacuum cleaner canister or may constitute a separate component. For example, wheeled bases are described in U.S. Pat. Nos. 5,528,794 and 5,598,605. Typically such bases include a small pair of steerable front wheels or casters and a larger pair rear wheels. However, such vacuums generally are not equipped with a handle in the front to facilitate movement of the unit, with the result that many users attempt to drag the vacuum by its hose attachment in order to move it. This method is inefficient because the hose attachment is ordinarily a separate component that is held in place on the vacuum only by a friction fit. As a result, it is easy to loosen the hose by dragging the vacuum unit in this manner. Other wet/dry vacuums are known that are provided with a handle suitable for pushing the vacuum in a desired direction. Moving the vacuum by pushing results in the application of a downward force on the rear of the vacuum, which makes it difficult for the front wheels to roll over obstacles such as door thresholds. In addition, this downward force can occasionally cause the vacuum to tip over. Accordingly, a need exists for a pull handle mounted toward the front of the vacuum so that the user may apply upward rather than downward force to the handle. This would make it much easier for the vacuum to roll over obstacles because of the reduced load on the front wheels. Such a pull handle would be preferably mounted high (on the lid of the vacuum) rather than low (e.g., on the canister) in order to prevent the user of average height from having to bend excessively to reach the handle.

Finally, it is desirable to make such a pull handle in a way that allows it to be mounted to the lid of the vacuum with a minimum number of fasteners in order to facilitate installation of the handle and to reduce the manufacturing cost of the vacuum. However, it is necessary to ensure that the attachment method still results in a handle that is firmly affixed to the lid.

SUMMARY OF THE INVENTION

In accordance with aspects of the present invention, a handle used for pulling a wet/dry vacuum appliance and a mechanism for securely mounting such a handle to the lid of the vacuum is disclosed. The mounting mechanism is designed for ease of assembly and reduced fastener cost. The handle is attached at two of its four attachment points by inserting journals molded into the sides of the handle into open bearing pockets molded in handle receiving recesses on the lid of the vacuum. The handle is then rotated into place and secured at the remaining two attachment points with suitable fasteners, such as screws. In certain embodiments of this invention, when the handle is rotated into position for attachment a locking slot in the bottom surface of the handle engages a rib provided in the handle receiving recess of the lid. This rib guides the handle as it rotates, prevents the journals from sliding back out of the bearing pockets, and locks the handle into the proper position for insertion of the fasteners.

In another aspect, the invention includes a wet/dry vacuum cleaning appliance that has a pull handle attached to its lid by the mechanism described above.

BRIEF DESCRIPTION OF THE DRAWINGS

The foregoing and other features and aspects of the invention will become further apparent upon reading the following detailed description and upon reference to the drawings in which.

Figure 1:
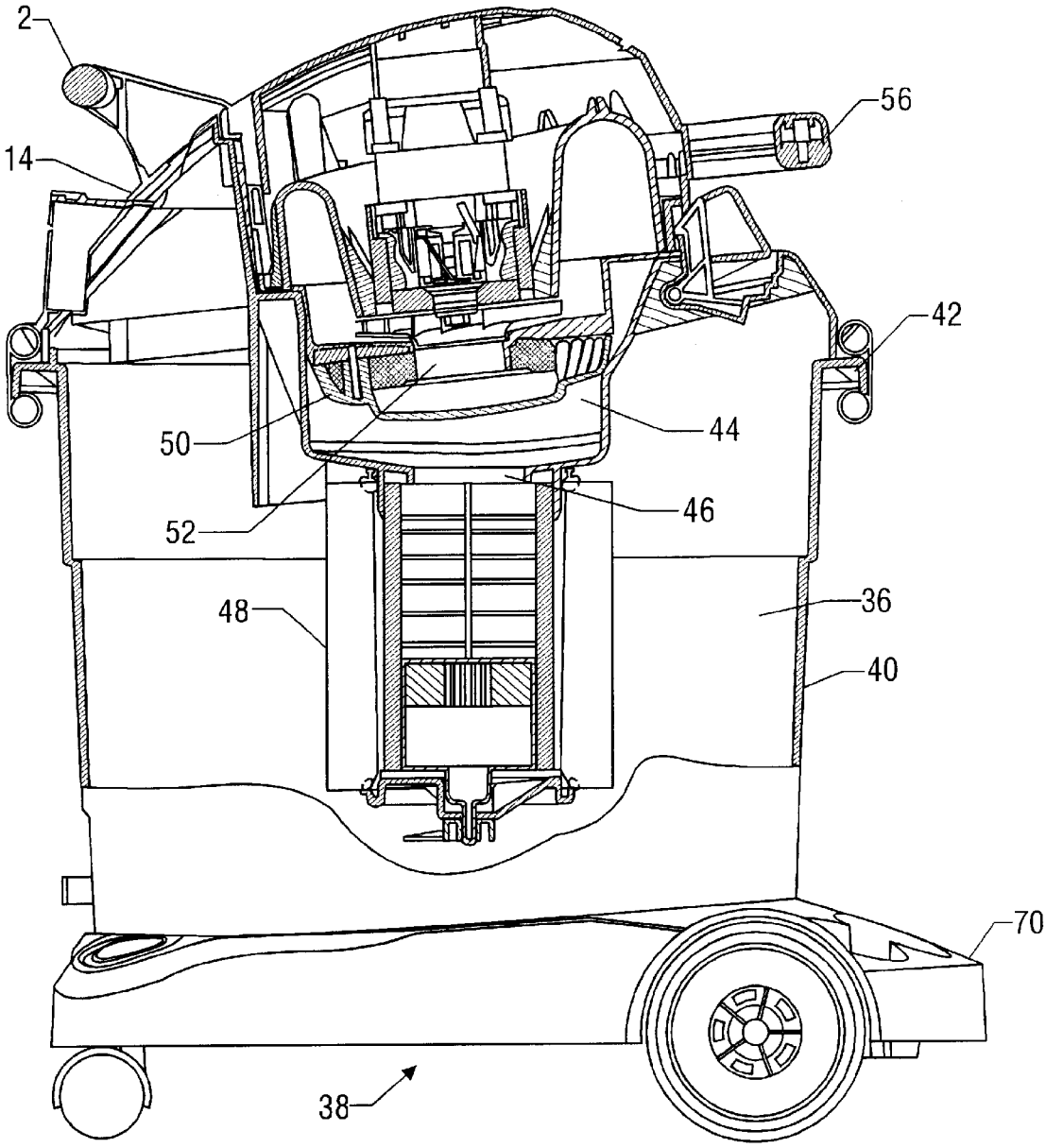
FIG. 1 is a side view of a wet-dry vacuum shown partially in section, with a pull handle according to one embodiment of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers'specific goals, such as compliance with system-related and businessrelated constraints, that will vary from one implementation to another. Moreover, it will be appreciated that such a development effort might be complex and time-consuming, but would nevertheless be a routine undertaking for those of ordinary skill in the art having the benefit of this disclosure.

Turning now to the Figures, and in particular, FIG. 1, one embodiment of the wet-dry vacuum cleaner pull handle with interlocking mount mechanism is disclosed. FIG. 1 discloses a complete vacuum cleaner appliance including handle 2, mounted to lid 14. Lid 14 exhibits a depression 44 with an opening 46 that communicates with a vacuum cleaner drum 36. Vacuum cleaner drum 36 comprises a bottom wall 38, a sidewall 40, and a rim 42 surrounding an open upper end. Lid 14 detachably mounts to rim 42 and extends across the open upper end of vacuum cleaner drum 36. A filter element 48 is mounted below depression 44 and within vacuum cleaner drum 36. Filter element 48 surrounds opening 46 in lid depression 44. A motor powered blower 50 may be at least partially received within depression 44. Blower 50 includes an intake port 52 for drawing air through filter element 48 and an exhaust port 54 (shown in FIG. 9) spaced from intake port 52 for exhausting air from vacuum cleaner drum 36. Blower 50 also includes a first handle 56 attached to one side of the blower for pushing the unit in a direction of travel. A second handle, i.e. pull handle 2, is mounted on lid 14 for pulling the vacuum cleaner appliance in the travel direction. The addition of pull handle 2 to the vacuum cleaner appliance allows the operator the convenience of pulling the vacuum from more than one direction.

Figure 9:
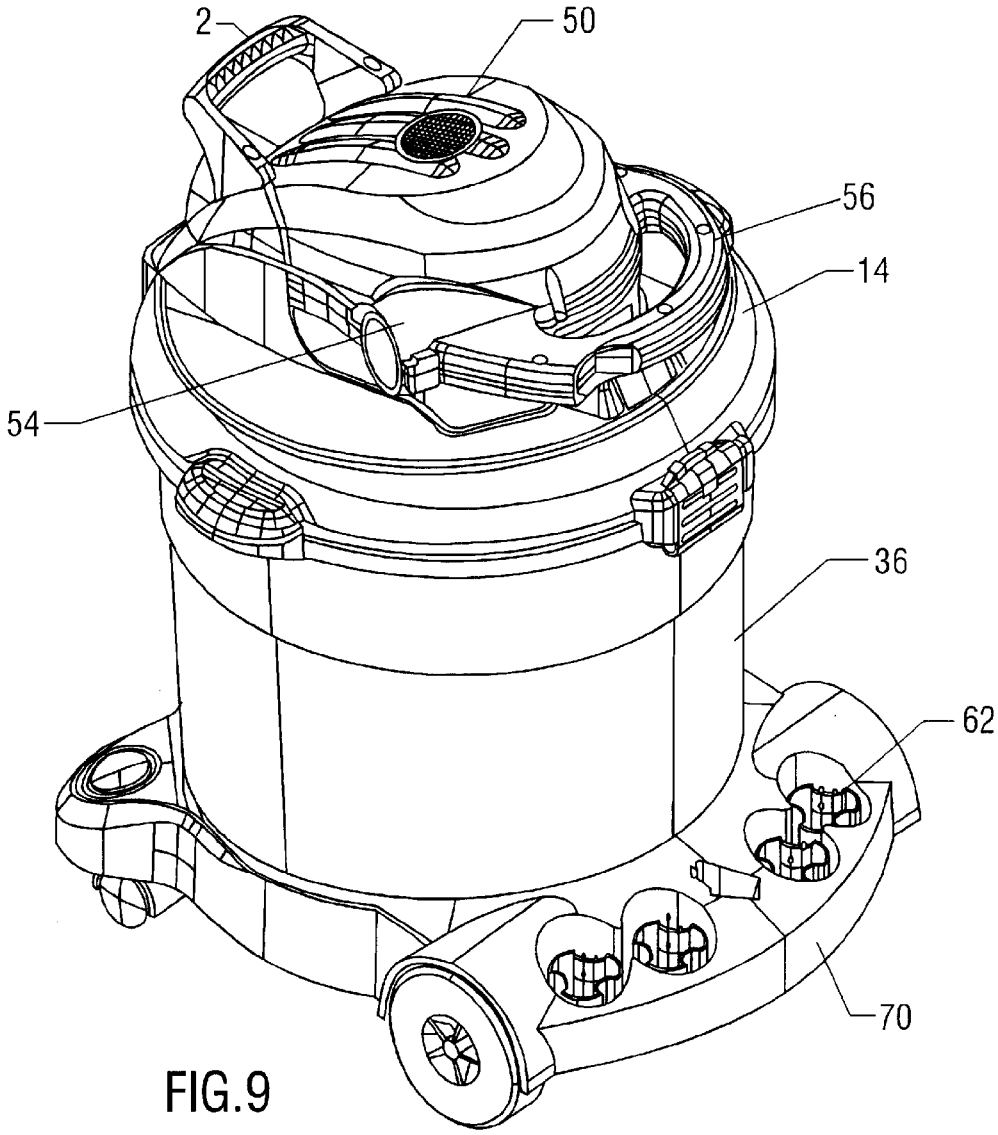
FIG. 9 is a perspective view of the wet dry vacuum in accordance with an embodiment of the present invention, set in a tool caddy.

Bottom wall 38 of drum 36 preferably rests on a tool caddy base as shown in FIGS. 1 and 9. Tool caddy base 70 is shown in FIG. 9 with several spaced attachment recesses 62 for receiving vacuum attachments (not shown). It will be understood that the attachments recesses 62 shown in FIG. 9 are not limited to size and shape shown the figure, attachment recesses 62 are representative of any number of convenient vacuum attachment recesses and may receive any convenient vacuum attachments for storage purposes.

Figure 2:
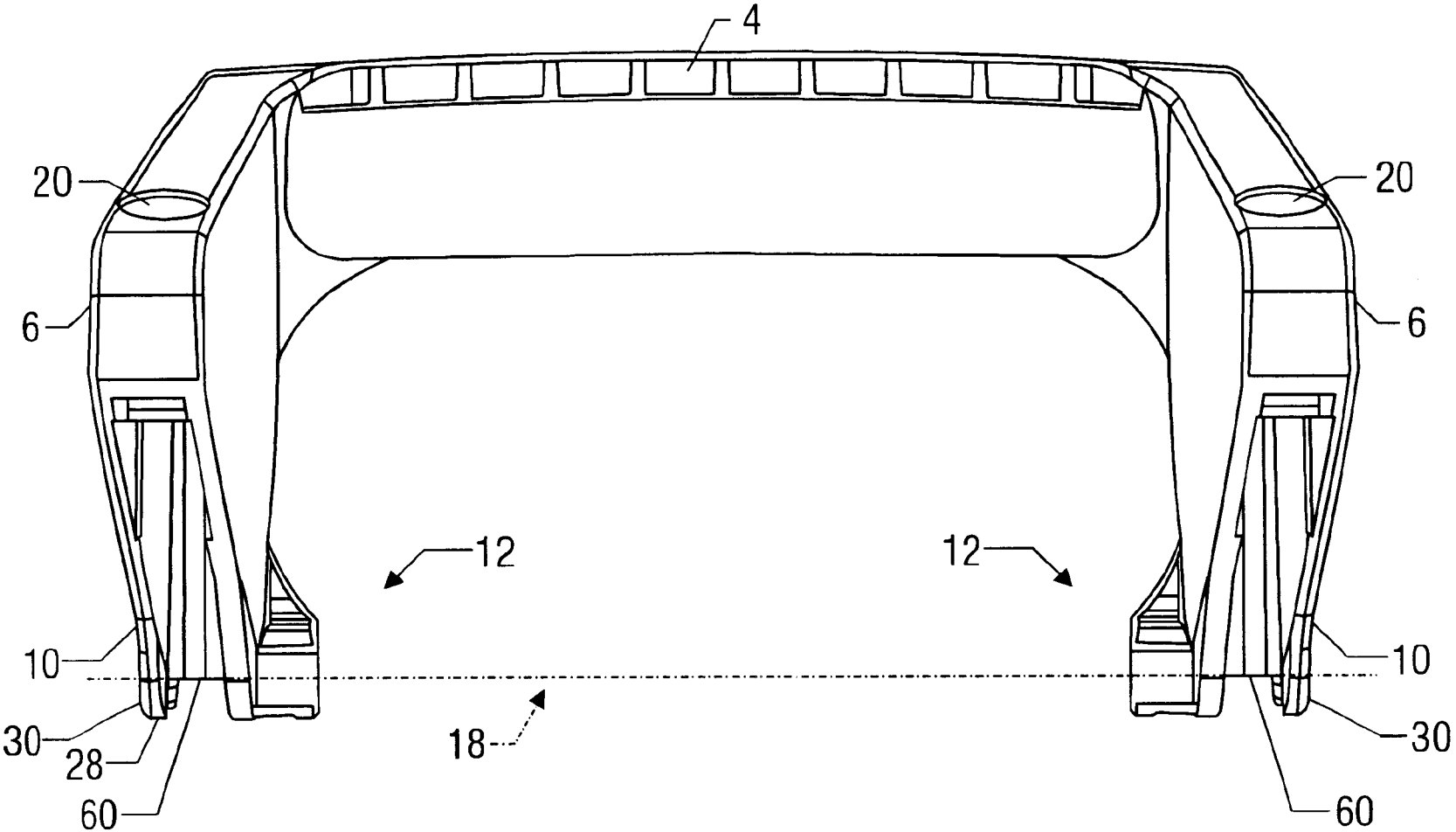
FIG. 2 is a back view of the pull handle shown in FIG. 1.
Figure 3:
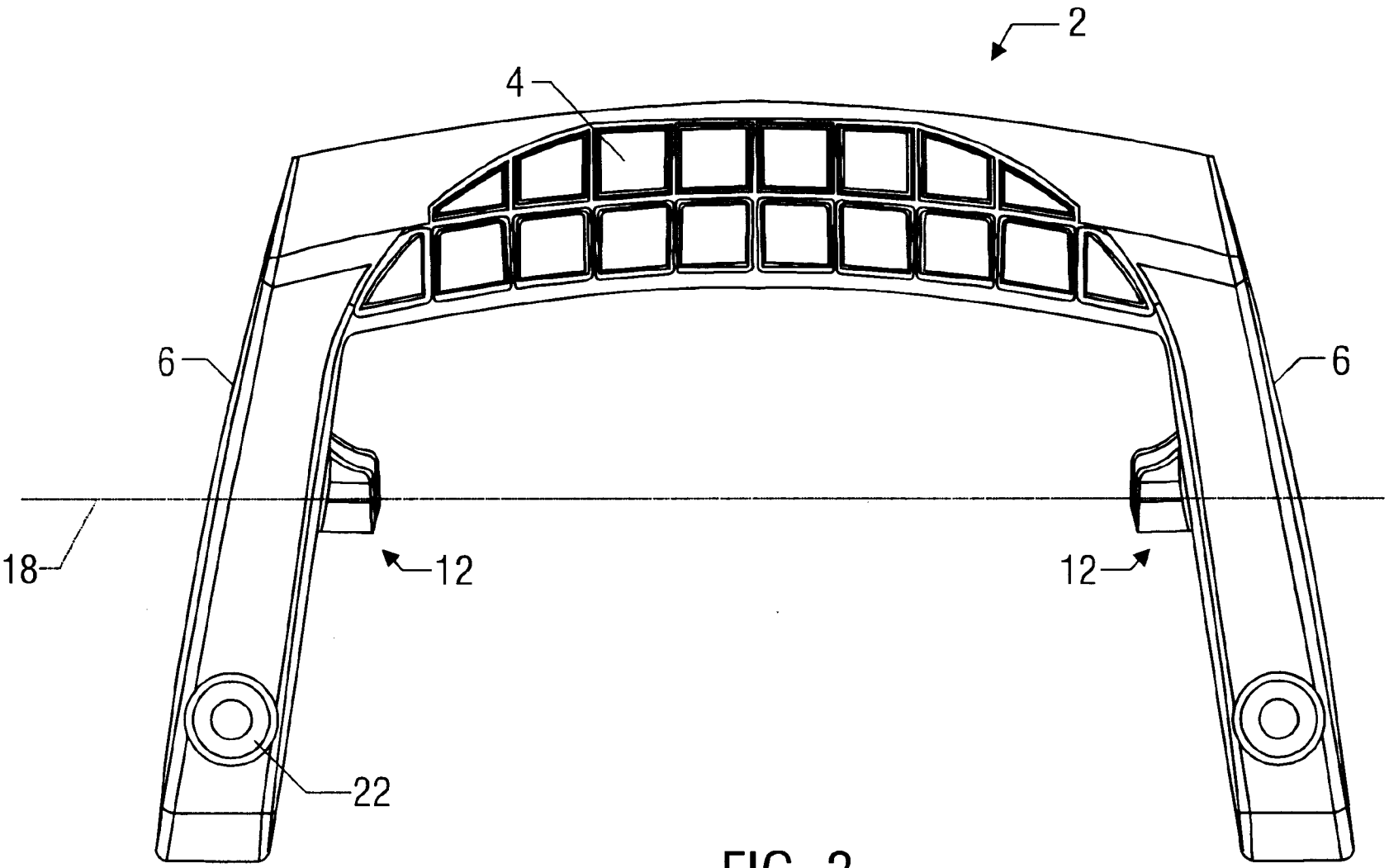
FIG. 3 is a top view of the pull handle shown in FIG. 1.
Figure 4:
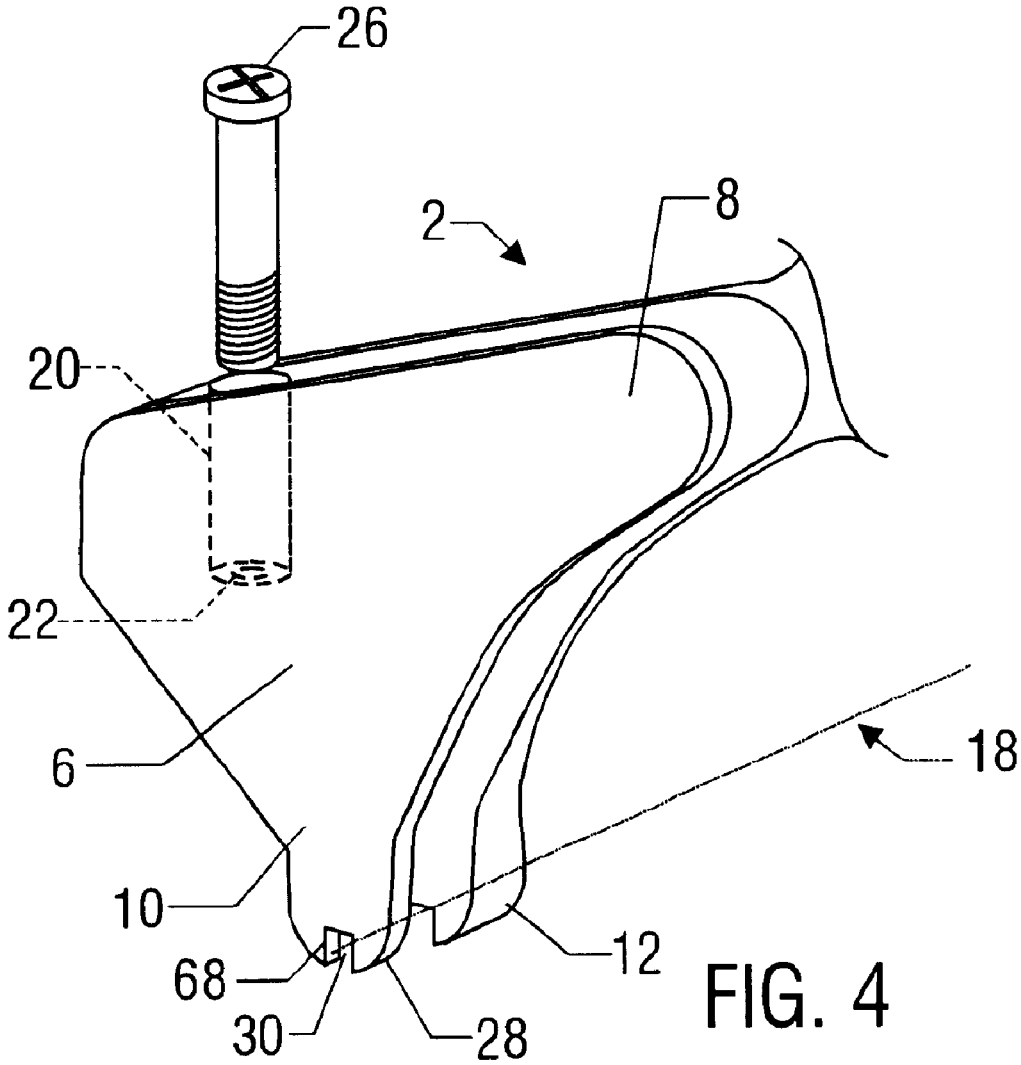
FIG. 4 is a perspective view of a portion of the pull handle shown in FIG. 1.

Turning next to FIGS. 2–4, one embodiment of pull handle 2 is shown. In an exemplary embodiment, pull handle 2 is adapted to be mounted on lid 14 of the wet-dry vacuum cleaning appliance shown in FIG. 1 to permit the appliance to be pulled in the direction of the handle. It will be understood that pull handle 2 may alternatively be mounted to any part of the vacuum, for instance, the drum 36, and is not limited to the lid-mount shown in the figures. The pull handle may also be used as a push handle.

Figure 6:
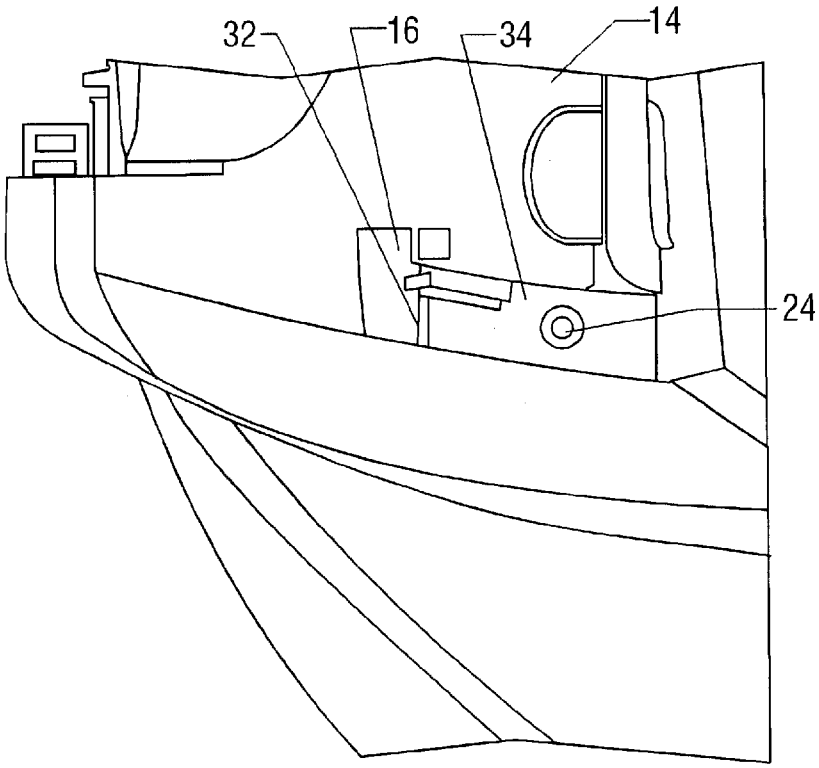
FIG. 6 is a partial top view of the wet-dry vacuum lid without the pull handle attached.
Figure 7:
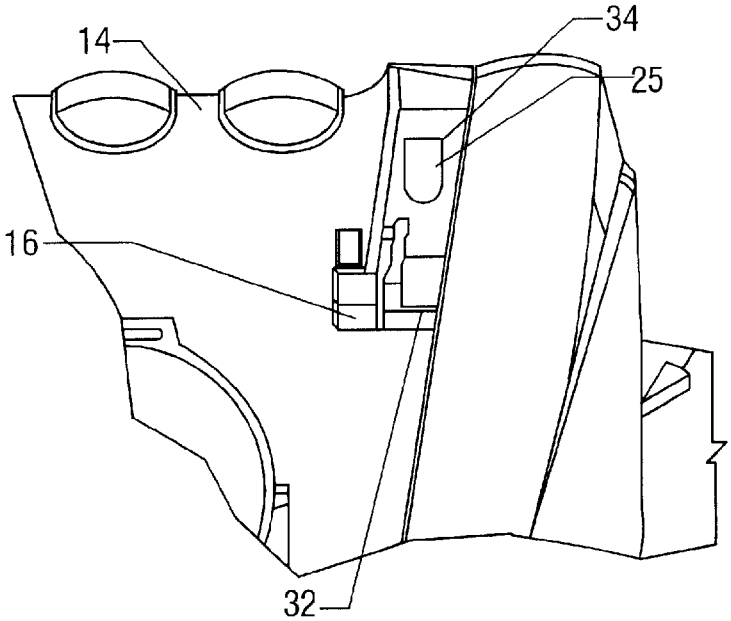
FIG. 7 is a partial front view of the wet-dry vacuum lid without the pull handle attached.

Pull handle 2 may include a grip portion 4, and at least two side portions 6 each having an end attached to grip portion 4 for support of pull handle 2. Pull handle 2 may include a plurality of journals 12 arranged adjacent second ends 10 the of the pull handle 2 along an axis 18. In the illustrated embodiment, the axis 18 is generally horizontal and situated substantially perpendicular to the pull direction. Each journal 12 is adapted to slidably engage a bearing pocket 16 on lid 14 and to rotate about axis 18. Bearing pocket 16 is shown in FIGS. 6 and 7 and may be disposed within an attachment recess 34 of lid 14. Pull handle 2 may also include an attachment portion, for example screw boss 20 extending from each of side portions 6. Screw boss 20 has a bore 22 therethrough at one end at a point remote from axis 18, such that when journals 12 are engaged in bearing pockets 16, and pull handle 2 is rotated by a predetermined angle about axis 18, bores 22 of screw boss 20 align with second bores 24 of a lid boss 25. Bores 22 and 24 are adapted to receive a fastener 26 to secure handle 2 to lid 14 and prevent further rotation about axis 18.

Figure 10A:
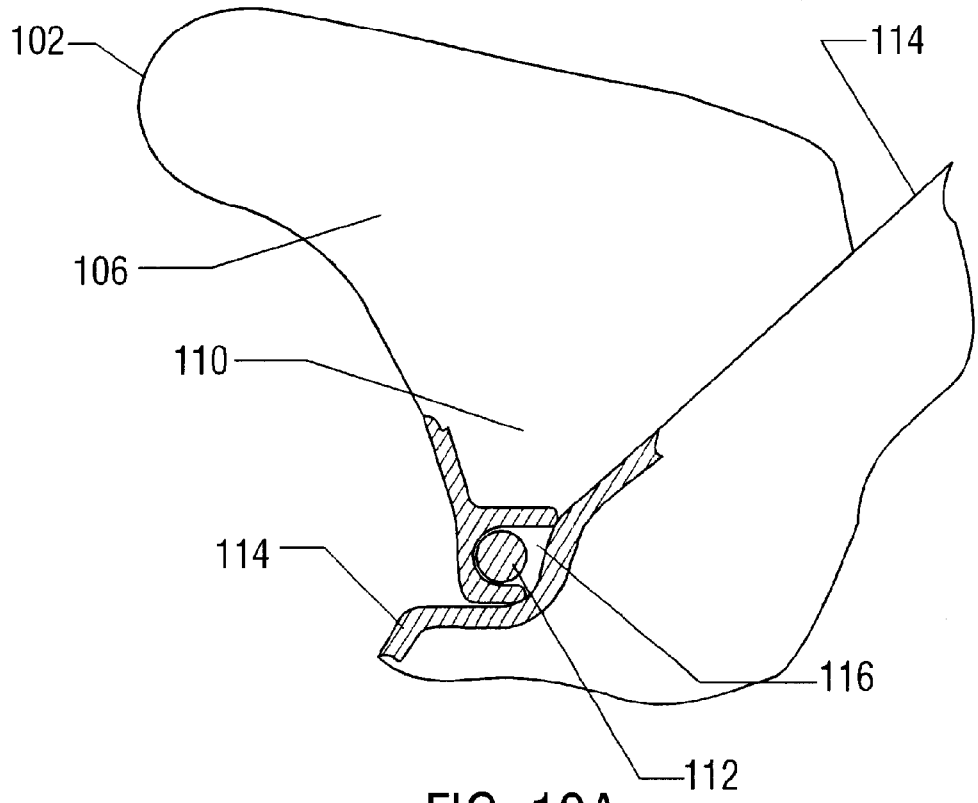
FIG. 10*a* is a side view, shown partially in section, of an alternative embodiment of the pull handle.

In an alternative embodiment, for example the embodiment shown in FIG. 10*a,* pull handle 102 has the plurality of bearing pockets 116 arranged adjacent second ends 110 of pull handle 102. In the embodiment illustrated in FIG. 10*a,* each of the pockets is positioned to slidably engage a journal 112 mounted on lid 114 and to allow pull handle 102 to rotate about the journal. This embodiment shows that the placement of journals may be on lid 114 with bearing pockets 116 on handle 102, or vice versa.

In one preferred embodiment shown in FIGS. 2–4, pull handle 2 exhibits a bottom surface 28 in each of side portions 6 defining a locking slot 30. Locking slot 30 may be located along axis 18 and is positioned to engage a locking rib 32 (shown in FIGS. 5–7) on lid 14 so as to secure journals 12 in bearing pockets 16 after handle 2 is rotated through a predetermined angle about axis 18. In the illustrated embodiment, locking slot 30 is slightly offset from axis 18.

Figure 10B:
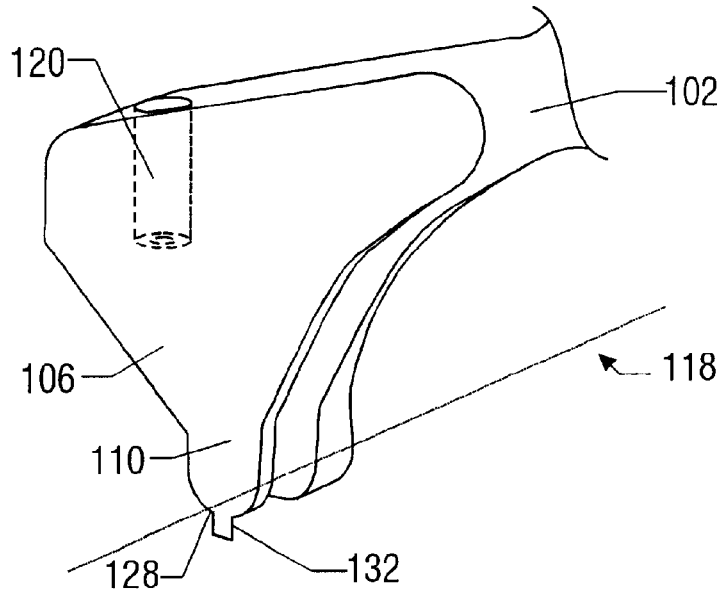
FIG. 10*b* is a perspective view of a portion of an alternative embodiment of the pull handle.

Alternatively, each of side portions 106 may exhibit at least one locking rib 132 formed in bottom surface 128 as shown in FIG 10*b*. The locking rib may be located along axis 118 and is positioned to engage a locking slot (not shown) on lid 114 so as to secure journals in bearing pockets (not shown) after handle 102 is rotated through a predetermined angle about axis 118. This alternative illustrates just the opposite of the locking mechanism described in the preceding paragraph.

Figure 8:
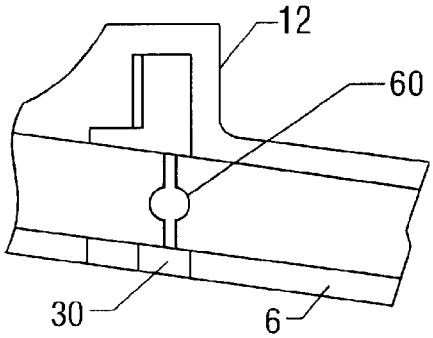
FIG. 8 is a bottom view of the attachment portion of the pull handle shown in FIG.1.

In some embodiments, pull handle 2 is fabricated with grip portion 4, side portions 6, attachment portions such as screw boss 20, and journals 12 fabricated as a single mold component. A webbing 60 as shown in FIG. 8 may reinforce a single mold component in which sides 6 are substantially hollow with locking slot 30 and journal 12 disposed on opposite surfaces of the sides.

Lid 14 exhibits receiving recesses 34 shown in FIGS. 6 and 7 to engage the attachment portions of pull handle 2 which include screw boss 20, journals 12, and locking slot 30 when handle 2 is rotated about axis 18.

In some embodiments such as the embodiment shown in FIG. 9, motor powered blower 50 is detachably mounted to lid 14 for independent operation separate from drum 36. This allows an operator to use the vacuum appliance as a blower. With motor powered blower 50 detached from drum 36, exhaust port 54 may be aimed at the convenience of the operator to act as a blower. Similar features on wet-dry vacuums are known in the art, for example in U.S. Pat. No. 5,598,605, which reference is incorporated herein in its entirety.

Figure 5A:
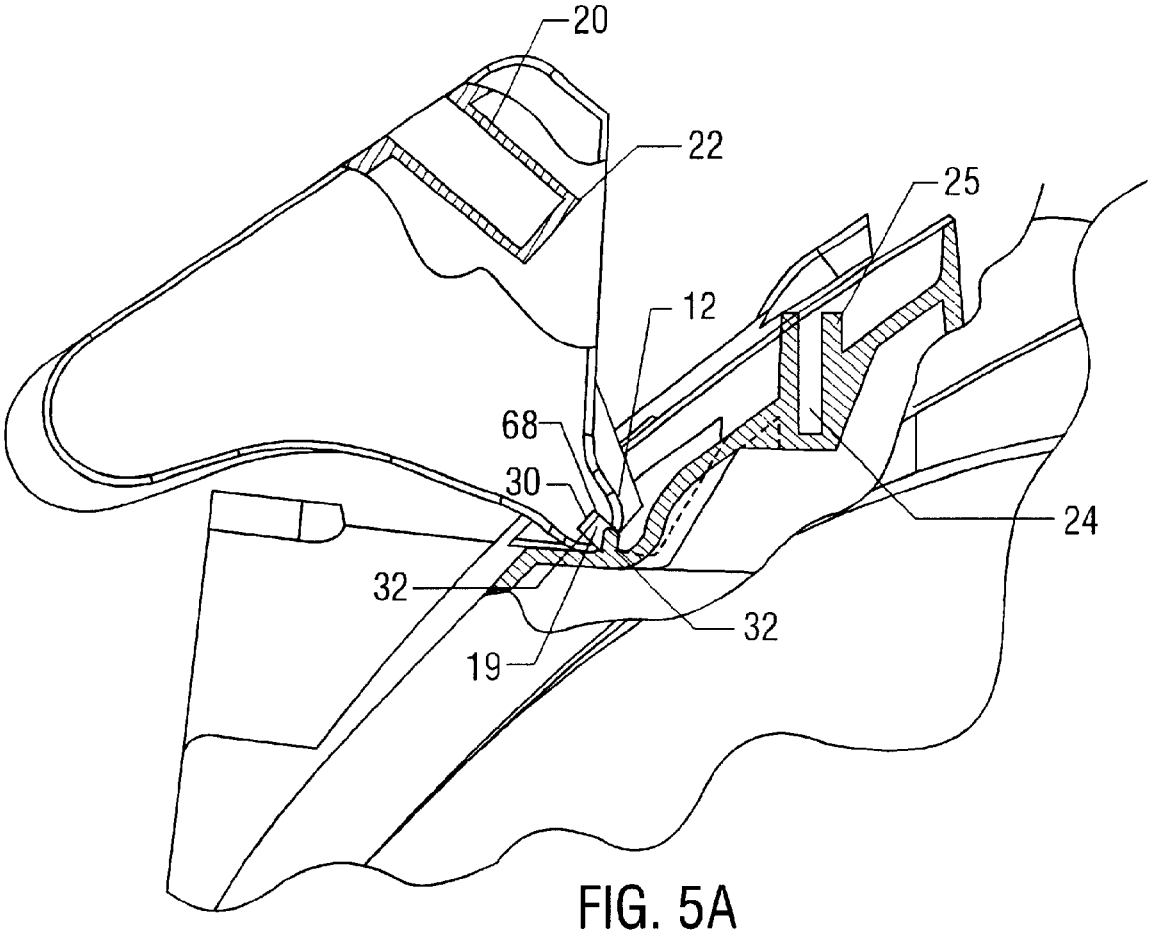
FIG. 5*a* is a side view, shown partially in section, of the pull handle shown in FIG. 1 in a pre-rotated position.
Figure 5B:
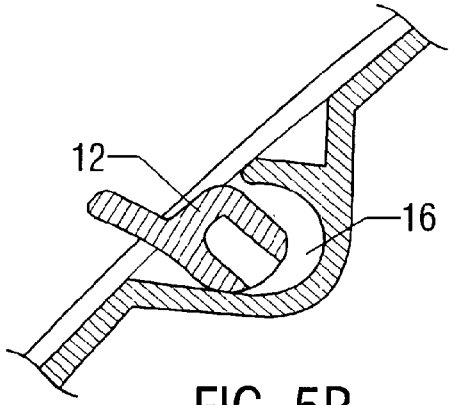
FIG. 5*b* is a cross section of the journal according to the position in FIG. 5*a*.
Figure 5C:
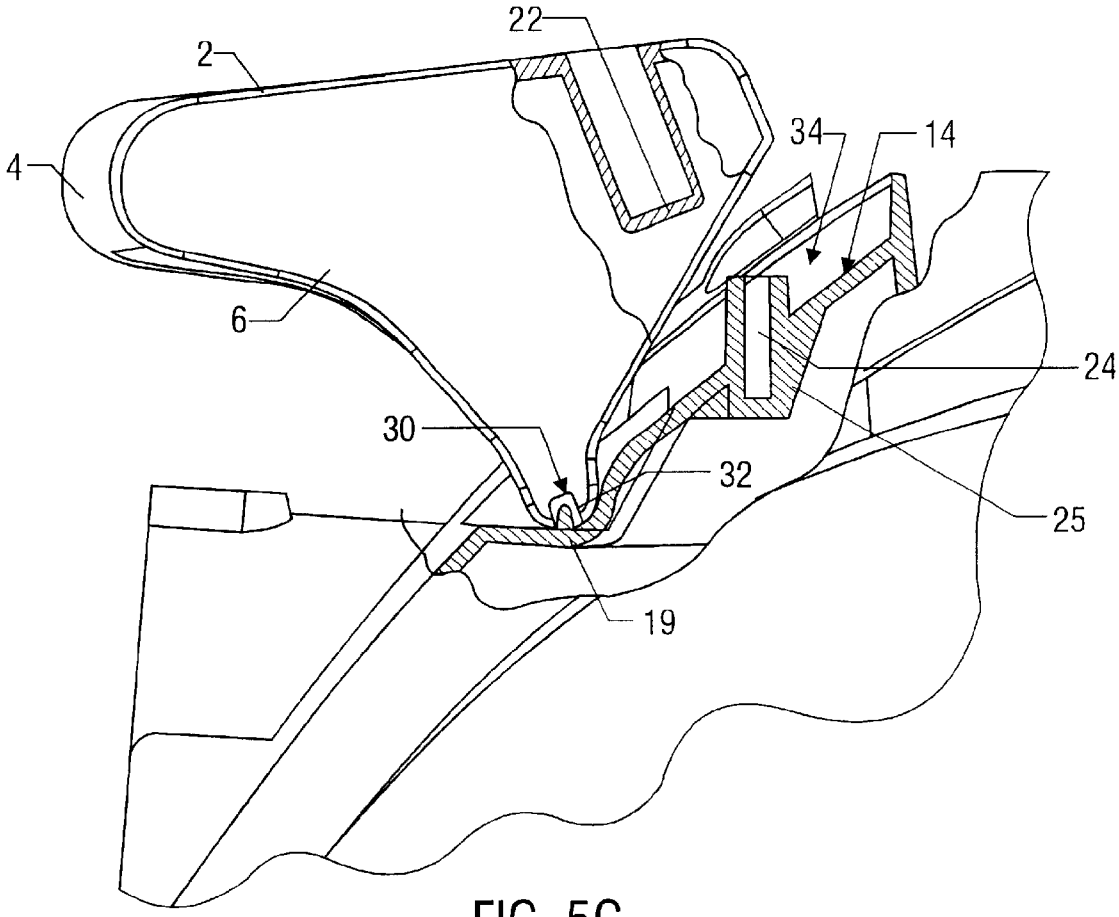
FIG. 5*c* is a side view, shown partially in section, of the pull handle shown in FIG. 1 in a partially-rotated position.
Figure 5D:
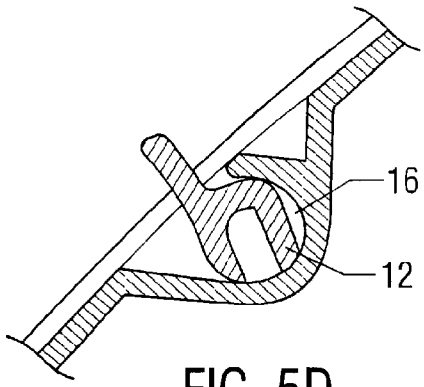
FIG. 5*d* is a cross section of the journal according to the position in FIG. 5*c*.
Figure 5E:
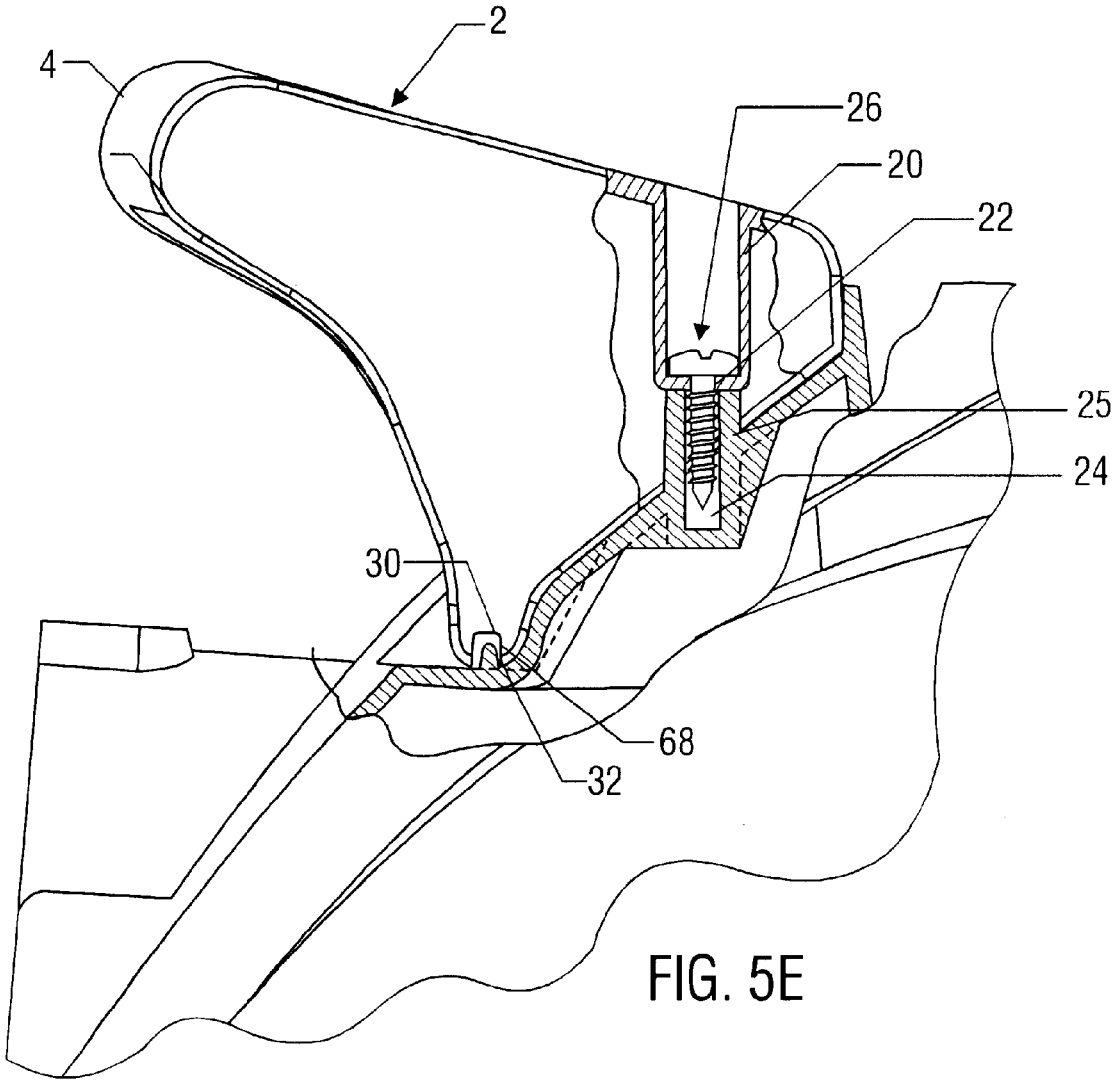
FIG. 5*e* is a side view, shown partially in section, of the pull handle shown in FIG. 1 in a post rotation position.
Figure 5F:
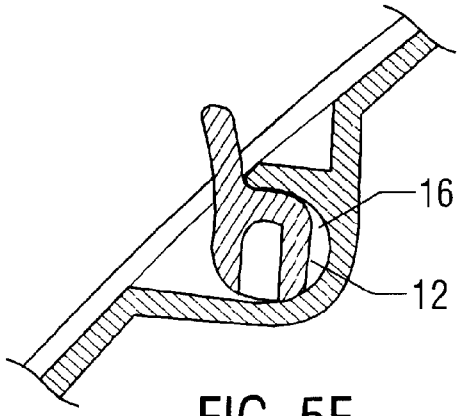
FIG. 5*f* is a cross section of the journal according to the position in FIG. 5*e*.

FIGS. 5*a*–5*f* show the steps of attaching pull handle 2 to lid 14. In FIG. 5*a* journal 12 is inserted into bearing pocket 16, while locking slot 30 begins to engage locking rib 32. FIG. 5*b* shows the details of the journal 12 within bearing pocket 16. Bore 22 in pull handle 2 is not aligned with bore 24 in lid boss 25 at the initial insertion position. Following insertion as shown in FIG. 5*a,* an operator may begin to rotate handle 2 about an axis normal to the page at point 19, which corresponds to axis 18 shown in the other figures, into further engagement with locking rib 32. FIG. 5*c* shows the handle in a partially rotated position and FIG. 5*d* shows the details of the journal 12 within bearing pocket 16 in the partially rotated position. Complete rotation through a predetermined angle results in the locked position shown in FIG. 5*e*. The new arrangement of journals 12 within bearing pocket 16 is shown in FIG. 5*f*. With the rotation of the handle through the predetermined angle, an edge 68 of locking slot 30 meets locking rib 32 and inhibits further rotation. Bore 22 in pull handle 2 meets coaxially with bore 24 in lid 14 following the rotation. A fastener 26 may then be inserted through bores 22 and 24 to secure pull handle 2 in place.

While the present invention has been particularly shown and described with reference to a particular illustrative embodiment thereof, it will be understood by those is skilled in the art that various changes in form and details may be made without departing from the spirit and scope of the invention. The above-described embodiment is intended to be merely illustrative, and should not be considered as limiting the scope of the present invention.

What is claimed is:

1. A pull handle for an appliance, said handle comprising:

a grip portion;

at least two side portions each having a first end attached to said grip portion, a second end, and a bottom surface defining a slot therein;

a plurality of journals arranged adjacent said second ends along an axis, each of said journals positioned to engage a beating pocket on said appliance and to rotate within said bearing pocket about the axis; and each of said slots positioned to engage a rib on said appliance so as to secure each of said journals in said bearing pockets after the handle is rotated through a predetermined angle about the axis.

2. The pull handle of claim 1 further comprising an attachment portion extending from each of said side portions, each of said attachment portions having a first bore therethrough at a point remote from the axis, such that when said journals are engaged in said bearing pockets and the handle is rotated by a predetermined angle about the axis, said attachment portions contact said appliance and each of said first bores aligns with a corresponding second bore in said appliance, said first and second bores adapted to receive a fastener to secure the handle and prevent furher rotation about the axis.

3. The pull handle of claim 2, wherein said grip portion, side portions, attachment portions and journals are fabricated as a single molded component.

4. The pull handle of claim 1 wherein each of said locking slots is located along the axis.

5. A pull handle for an appliance, said handle comprising:

a grip portion;

at least two side portions each having a first end attached to said grip portion and a second end;

a plurality of bearing pockets arranged adjacent said second ends along an axis, each of said pockets positioned to engage a journal mounted on said appliance and to rotate on said axis about said journal; and an attachment portion extending from each of said side portions, each of said attachment portions having a first bore therethrough at a point remote from said axis, such that when said journals are engaged in said bearing pockets and the handle is rotated by a predetermined angle about said axis, said attachment portions contact said appliance and each of said first bores aligns with a second bore in said appliance, said first and second bores adapted to receive a fastener to secure the handle and prevent further rotation about said axis.

6. A pull handle assembly for attachment to a wet-dry vacuum unit, comprising:

a grip portion;

means for supporting said grip portion;

means fixed on said vacuum for receiving said supporting means to permit rotation of said supporting means on an axis passing through said means for receiving;

means for preventing further rotation of said supporting means after a predetermined rotation of said supporting means about said axis and for securing said supporting means to said vacuum after said predetermined rotation.

7. A pull handle for an appliance, said handle comprising:

a grip portion;

at least two side portions each having a first end attached to said grip portion;

an attachment portion extending from each of said side portions, each of said attachment portions having a first bore therethrough;

wherein each of said side portions further comprises a bottom surface defining a slot therein, each of said slots positioned to engage a rib on said appliance so as to place said handle in a position of alignment between said first bores in said handle and corresponding second bores in said appliance after send handle is rotated through a predetermined angle about a handle axis.

8. A pull handle for an appliance, said handle comprising:

a grip portion;

at least two side portions each having a first end attached to said grip portion and a second end;

a plurality of journals arranged adjacent said second ends along an axis, each of said journals positioned to engage a bearing pocket on said appliance and to rotate within said bearing pocket about the axis; and an attachment potion having a first bore therethrough at a point remote from the axis, such that when said journals are engaged in said bearing pockets and the handle is rotated by a predetermined angle about the axis, said attachment portions contact said appliance and each of said first bores aligns with a corresponding second bore in said appliance, said first and second bores adapted to receive as fastener to secure the handle and prevent further rotation about the axis.

9. The pull handle of claim 8, wherein said grip portion, side portions, attachment portions and journals are fabricated as a single molded component.

10. A pull handle for an appliance, said handle comprising:

a grip portion;

at least two side portions each having a first end attached to said grip portion, a second end, and a bottom surface;

a plurality of journals arranged adjacent said second ends along an axis, each of said journals positioned to engage a bearing pocket on said appliance and to rotate within said bearing pocket about the axis; and and at least one rib formed in said bottom surface, said rib located along the axis and positioned to engage a slot on said appliance so as to secure said journals in said bearing pockets after the handle is rotated through a predetermined angle about the axis.

* * * * *

UNITED STATES PATENT AND TRADEMARK OFFICE

CERTIFICATE OF CORRECTION

PATENT NO. : 6,378,165 B1 
DATED : April 30, 2002
INVENTOR(S) : Stuart V. Holsten and David E. Beth It is certified that error appears in the above-identified patent and that said Letters Patent is hereby corrected as shown below:

Column 5,
Line 22, delete "beating" and insert -- bearing --.

Column 6,
Line 43, delete "as" and insert --a --.

Signed and Sealed this

Eighth Day of October, 2002

*Attest:*

*Attesting Officer*

JAMES E. ROGAN
*Director of the United States Patent and Trademark Office*